US005562235A

United States Patent [19]

Cruysberghs

[11] Patent Number: 5,562,235

[45] Date of Patent: Oct. 8, 1996

[54] PRESSURE GENERATOR AND DISPENSING APPARATUS UTILIZING SAME

[76] Inventor: Rudiger J. C. Cruysberghs, Sterstraat 15, 2310 Rijkevorsel, Belgium

[21] Appl. No.: 344,137

[22] Filed: Nov. 23, 1994

Related U.S. Application Data

[62] Division of Ser. No. 876,661, Apr. 30, 1992, Pat. No. 5,368,207.

[51] Int. Cl.[6] ..... B65D 83/00

[52] U.S. Cl. ..... 222/396; 222/399; 169/85; 137/509

[58] Field of Search ..... 222/399, 394, 222/396; 169/85; 137/509

[56] References Cited

U.S. PATENT DOCUMENTS

| | | | |
|---|---|---|---|
| 2,950,846 | 8/1960 | Clark et al. | 222/399 |
| 3,258,163 | 6/1966 | Brush | 222/399 X |
| 3,322,304 | 5/1967 | Wilson | 222/52 |
| 3,460,555 | 8/1969 | Puster | 137/12 |
| 3,613,954 | 10/1971 | Bayne | 222/61 |
| 3,815,793 | 6/1974 | Morane et al. | 222/399 |
| 4,310,108 | 1/1982 | Motoyama et al. | 222/396 |
| 4,441,632 | 4/1984 | Stoody | 222/129 |
| 4,456,155 | 6/1984 | Miyata et al. | 222/396 |
| 4,995,533 | 2/1991 | Vandoninck | 222/54 |
| 5,011,047 | 4/1991 | Cruysberghs | 222/396 |
| 5,090,595 | 2/1992 | Vandoninck | 222/54 |
| 5,110,014 | 5/1992 | Doundoulakis | 222/396 |
| 5,133,701 | 7/1992 | Han | 604/289 |
| 5,368,207 | 11/1994 | Cruysberghs | 222/396 X |

FOREIGN PATENT DOCUMENTS

| | | |
|---|---|---|
| 1399246 | 4/1965 | France . |
| 2639920 | 6/1990 | France . |
| 9015377 | 12/1990 | WIPO . |

*Primary Examiner*—Andres Kashnikow
*Assistant Examiner*—Lisa Douglas
*Attorney, Agent, or Firm*—Haynes and Boone, L.L.P.; Jeffrey M. Becker

[57] ABSTRACT

An apparatus disposed within a pressurized container for enabling product contained in the container to be dispensed at a predetermined constant pressure, which apparatus includes a vessel having first and second enclosures housing pressurized gas and a member exposed to the pressure in the container. Fluctuations of the pressure in the container cause the member to move to a first position when the pressure in the container equals the predetermined pressure and to a second position when the pressure in the container is below the predetermined pressure. Pressurized gas passes from the first enclosure to the container when the member moves to the second position, the passage of which is prevented when the member moves back to the first position.

29 Claims, 5 Drawing Sheets

PRESSURE GENERATOR AND DISPENSING APPARATUS UTILIZING SAME

This is a divisional of application Ser. No. 07/876,661 filed on Apr. 30, 1992 now U.S. Pat. No. 5,368,207.

BACKGROUND OF THE INVENTION

1. Field of the Invention

The present invention relates to a pressure generator and, more particularly, to a dispensing apparatus utilizing such a pressure generator for dispensing product from sealed containers.

2. Description of the Prior Art

Aerosol pressurized dispensers have become familiar, if not essential, products in both consumer and industrial use due to the efficient way in which they discharge a myriad of products.

A common example is the hair spray dispenser in which, inside the dispenser, the product spray is dispersed in and surrounded by a liquefied propellant gas under pressure forming a uniform, single phase mixture of the product spray and the liquefied propellant. As the product release valve is pressed, the liquefied propellant immediately vaporizes forcing the product spray out of the dispenser in the form of a fine mist.

A second type of aerosol dispenser, the cheese spread dispenser being a common example, discharges the product, not as a fine mist, but as a solid. In this second category of aerosol dispensers, the propellant exists within the dispenser as a gas and does not mix with the product. Rather, it forms a separate layer over the product to be discharged. As the product release valve is pressed, the propellant, being under pressure, pushes the product out of the dispenser.

The most commonly used propellants are butane, nitrogen and chlorinated fluorohydrocarbons (CFC's), such as those sold under trade name of Freon. CFC's and butane are often preferred over nitrogen since their vapor pressures are independent of the volume of free headspace in the dispenser. Thus, as long as some of the CFC or butane is present in the dispenser, the pressure exerted on the product is virtually constant throughout the discharge life of the system.

However, both CFC's and butane have adverse effects on the environment. CFC's add to the destruction of the earth's protective ozone layer which has lead the world community to seek a complete ban of CFC usage. Many countries have already banned its use or have implemented programs and schedules designed to eliminate CFC usage in the near future. Butane, on the other hand, is extremely flammable, making storage, handling and use of butane charged containers very hazardous. In addition, butane contaminates the flavor and smell of the dispensed product, thereby further restricting its use.

Although nitrogen is available as a substitute propellant, its vapor pressure is such that as product is dispensed, the propellant pressure decreases. Therefore, the product cannot be dispensed at a constant pressure through the life of the product, and at some point, the propellant pressure will fall below that needed to propel any product from the dispenser. To enable all of the product to be dispensable, the nitrogen must be pressurized to dangerously high levels increasing the risk of rupture or requiring more costly dispenser construction.

SUMMARY OF THE INVENTION

The dispensing apparatus of the present invention overcomes the above-noted disadvantages and drawbacks which are characteristic of the prior art.

The dispensing apparatus of the present invention comprises a pressure generator, utilizing an inert, environmentally safe propellant gas, disposed in a container for pressurizing the container to provide for the consistent discharge of product. In a preferred embodiment, the pressure generator includes a vessel disposed in the container for receiving a cylinder in which a piston reciprocates in response to changes in pressure in the container caused by dispensing of the product. When the piston is at a first predetermined position relative to the cylinder in response to the pressure in the container being at a predetermined value, flow of the gas into the container is prevented. When the piston attains a second position relative to the cylinder in response to pressure in the container being reduced as a result of dispensing the product, relatively high pressure gas from the vessel is discharged into the container to maintain a constant pressure in the container.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENTS

Figure 1:
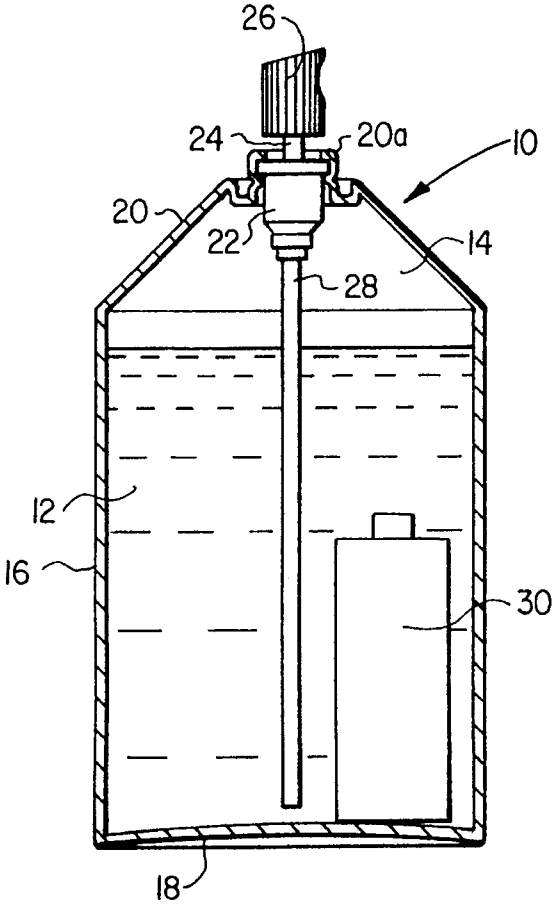
FIG. 1 is a front elevational view, partially in section, showing the dispensing apparatus of the present invention.

Referring to FIG. 1 of the drawings, the reference numeral 10 refers in general to a container, or can, containing a product 12 and a pressurized headspace 14. The container 10 is formed by a cylindrical wall 16 closed at its lower end by a bottom plate 18 and at its upper end by a cap 20. It is understood that the container 10 can be an aerosol can, a vat, a beer or beverage keg, a storage vessel, a bottle or any other type of container used for the storage and dispersement of a product and can have any desired shape or configuration.

The cap 20 has a raised central portion 20*a* which receives a valve 22. A hollow actuating stem 24 extends from the valve 22 and through an opening formed through the raised cap portion 20*a* and receives a hollow push button 26. A tube 28 is disposed in the container 10 in a coaxial relationship therewith. The lower end of the tube 28 is slightly spaced from the bottom plate 18 and the upper end extends into the valve 22. The valve 22 is normally closed but when the push button 26 is manually pushed downwardly, the valve opens to connect the tube 28 with the stem 24. This permits the product 12 in the container 10 to flow through the tube 28, the valve 22, the stem 24 and to the push button 26 from which it discharges outwardly through discharge openings in the push button, as will be explained. Since these components are conventional they will not be described in any further detail.

A pressure generator for pressurizing the headspace 14 is disposed in the container 10, and is referred to in general by the reference numeral 30. Referring to FIG. 2A, the pressure generator 30 is formed by a vessel 32 having a closed lower end portion and an upper end which narrows to form a shoulder 32*a* and a neck 32*b* which defines an opening 32*c*. The neck 32*b* is adapted to receive a plug 34 having a continuous bore 34a extending therethrough. In a preferred embodiment, the neck 32*b* is pliable and the diameter of the plug 34 slightly larger than the opening 32*c*, such that the plug 34 press fits into the bore 34*a*, slightly deforming the neck 32*b*.

A cylinder 36 is disposed in the vessel 32 and has a closed lower end and an open upper end. The upper end is integrally connected to the shoulder 32*a* of the vessel 32 by welding or the like. The diameter and the length of the cylinder 36 are less than the diameter and length, respectively, of the vessel 32 to define a high pressure chamber 38.

An opening 36*a* is provided through the wall of the cylinder 36 and a notch, or groove, 36*b* is formed in the inner surface of the cylinder 36 and extends above the opening 36*a*, for reasons to be described. A piston 40 operates within the cylinder 36, the outer diameter of the piston 40 being slightly less than the inner diameter of the cylinder 36 to permit reciprocal movement of the piston 40 in the cylinder 36 and to define a flow passage therebetween. Two axially spaced annular grooves are provided near the respective ends of the piston 40 and receive two sealing members, preferably in the form of O-rings, 42 and 44. The cross-sectional area of the O-ring 42 is less than that of the corresponding cross-sectional area of the notch 36*b*, for reasons to be described.

A prepressure chamber 46 is defined between the respective lower ends of the piston 40 and the cylinder 36 which is pressurized to urge the piston 40 upwardly, as will be described. In a preferred embodiment, a spring 48 extends in the chamber 46 which also urges the piston 40 upwardly. In the position shown in FIG. 2A, the piston 40 is in its upper position in which its upper end engages the plug 34, thereby preventing any further upward movement of the piston 40.

Before operation, the chambers 38 and 46 of the vessel 32 are charged to respective predetermined pressures with a quantity of inert gas such as air, nitrogen, nitrous oxide, carbon dioxide or the like. In a preferred embodiment, the chamber 46 is charged to a pressure that is approximately equal to the pressure found in the headspace 14 needed to propel the product 12 from the container 10. The chamber 38 is pressurized to a greater pressure than the chamber 46 to recharge the headspace 14 as is described below.

To charge the chamber 46, the piston 40 is moved downwardly such that the upper O-ring 42 is below the opening 36*a* of the cylinder 36. Then, pressurized gas is introduced from the opening 32*c* of the vessel 32 through the bore 34*a* of the plug 34, which gas passes through the opening 36*a* of the cylinder 36 and into the chamber 38. Once the pressure in the chamber 38 reaches a predetermined level, the plug 34 is removed and the piston 40 is raised such that the lower O-ring 44 is above the opening 36*a* of the cylinder 36 to allow the gas to pass through the opening 36*a* and fill the chamber 46. The piston 40 is then lowered to the position shown in FIG. 2A such that the lower O-ring 44 is below the opening 36*a* to seal the gas in the chamber 46. The piston 40 is prevented from ejecting from the cylinder 36 by the reinsertion of the plug 34, or in a preferred embodiment and as shown in FIG. 2B, by the neck 32*b* of the vessel 32 which is folded down to partially block the opening 32*c*.

To charge the chamber 38, the piston 40 is further lowered such that the upper O-ring 42 is below the opening 36*a* of the cylinder 36. Additional pressurized gas is then introduced from the opening 32*c* through the bore 34, which additional gas passes through the opening 36*a* of the cylinder 36 and into the chamber 38. The introduction of this additional gas is continued until the chamber 38 is pressurized to the predetermined level. Thereafter, the piston 40 is allowed to be urged to the position shown in FIG. 2A where the upper end of the piston 40 engages the plug 34. In this position, the upper O-ring 42 engages corresponding portions of the inner wall of the cylinder 36 to seal against the flow of the pressurized gas contained in the chamber 38 out of the vessel 32 and into the container 10 via the space between the piston 40 and the cylinder 36; while the lower O-ring 44 seals against the flow of gas to and from the chamber 46. While in this position, the pressure generator 30 can be moved and transported without accidentally depressurizing either of the chambers 38 or 46.

After the chambers 38 and 46 are charged, the pressure generator 30 is placed in the container 10 which contains the product 12 to be dispensed, and the headspace 14 in the container 10 is charged to a predetermined pressure with a gas similar to the gas used to charge the chambers 38 and 46 of the vessel 32, which pressure is selected to be initially greater than the combined force exerted on the piston 40 by the gas and the spring 48 in the chamber 46. After the container 10 is sealed off, or closed, the pressure in the container 10 acts through the opening 32*c* of the vessel 32 via the bore 34*a* of the plug 34 on the upper end of the piston 40 to force it downwardly to the operating position shown in FIG. 2B. In this operating position, both O-rings 42 and 44 engage the inner wall of the cylinder 36 to prevent any flow of the pressurized gas through the cylinder 36, and the upper O-ring 42 extends between the opening 36*a* and the notch 36*b*.

Figure 2B:
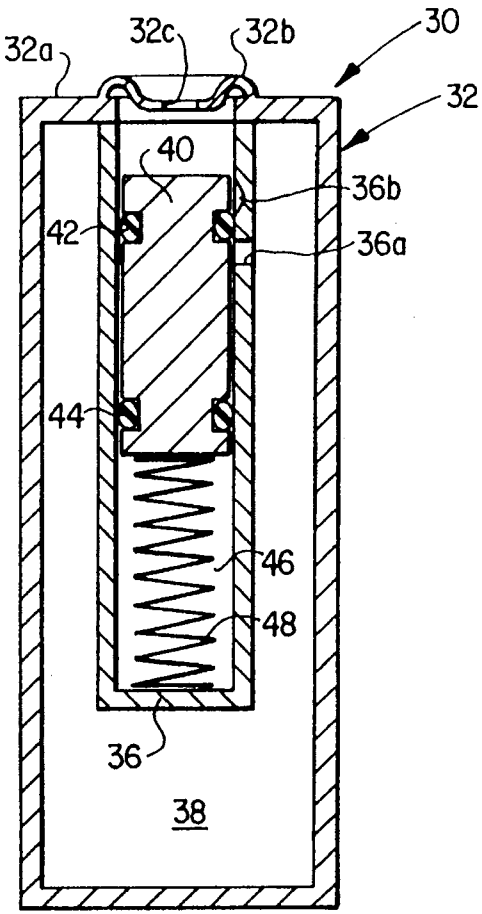
FIGS. 2A and 2B are enlarged sectional views of the pressure generator of the apparatus of FIG. 1 shown in different operating modes.
Figure 2A:
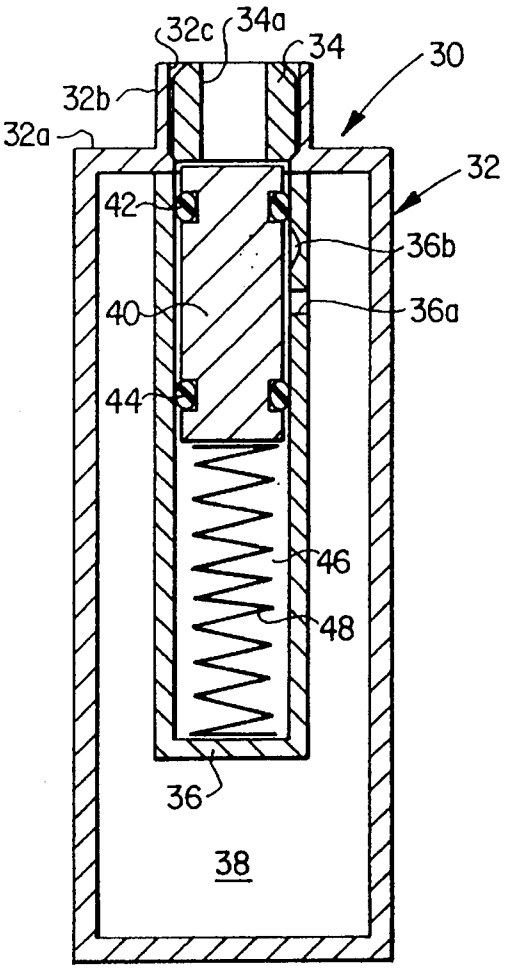

The piston 40 remains in the position shown in FIG. 2B until the container 10 is used by manually pressing the push button 26, in which case the pressure in the headspace 14 of the container 10 propels the product 12 through the tube 28, the valve 22, the stem 24 and outwardly through the openings in the push button 26. This causes the pressure in the container 10 to decrease until the pressures exerted on the lower end of the piston 40 by the pressurized gas in the chamber 46 and the spring 48 (if present) are greater than the corresponding pressure acting on the upper end of the piston 40 by the pressurized product 12 in the container 10. Upon this occurring, the piston 40 moves upwardly until the upper O-ring 42 extends in the notch 36*b* of the cylinder 36. This permits the high pressure gas in the chamber 38 to pass through the opening 36*a*, through the space between the outer surface of the piston 40 and the inner surface of the cylinder 36, through the notch 36*b* and outwardly through the upper opening 32*c* of the vessel 32.

The pressure in the container 10 is thus increased accordingly until the pressure exerted thereby on the upper end of the piston 40 is sufficient to overcome the pressure exerted on the lower end of the piston 40 by the spring 48 and the pressure in the chamber 46. At this point, the piston 40 will move back to the position shown in FIG. 2B thus blocking any further flow of high pressure gas from the chamber 38 into the container 10 as described above. Note however, that should the pressure in the container 10 quickly drop a significant amount, such as due to a leak, the pressure in the chamber 46 will force the piston 40 against the plug 34 (or the folded down neck 32*c*), thereby sealing the high pressure gas in the chamber 38 by the upper O-ring 42.

This back-and-forth movement of the piston 40 relative to the cylinder 36 continues in the manner described above as the product 12 is periodically dispensed from the container 10. As a result, a constant pressure will be available in the container 10 at all times to propel the product 12 from the container 10, while the propellant utilized can be an inert gas which is not harmful to the environment.

Figure 3:
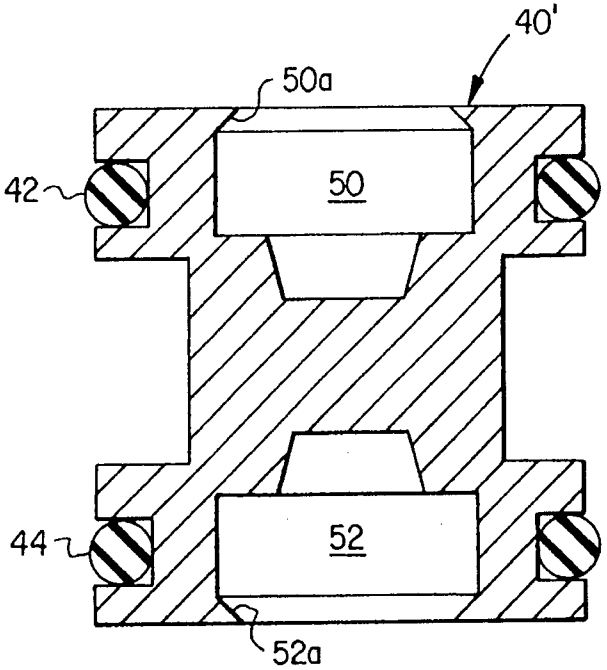
FIG. 3 is an enlarged sectional view of another preferred embodiment of a portion of the pressure generator.

To facilitate the previously described charging of the chambers 38 and 46 of the pressure generator 30, an alternative piston 40' may be disposed in the cylinder 36. The piston 40' is shown in FIG. 3 and has two axially spaced annular grooves provided near its ends for receiving the O-rings 42 and 44. Upper and lower wells 50 and 52 having annular flanges 50*a* and 52*a* are provided in the upper and lower ends of the piston 40', respectively, for receiving a tool (not shown), such as a spheric pen, to axially position the piston 40' during charging of the chambers 38 and 46. Otherwise, the operation of the piston 40' is identical to that of the embodiment of FIGS. 2A and 2B.

Figure 4:
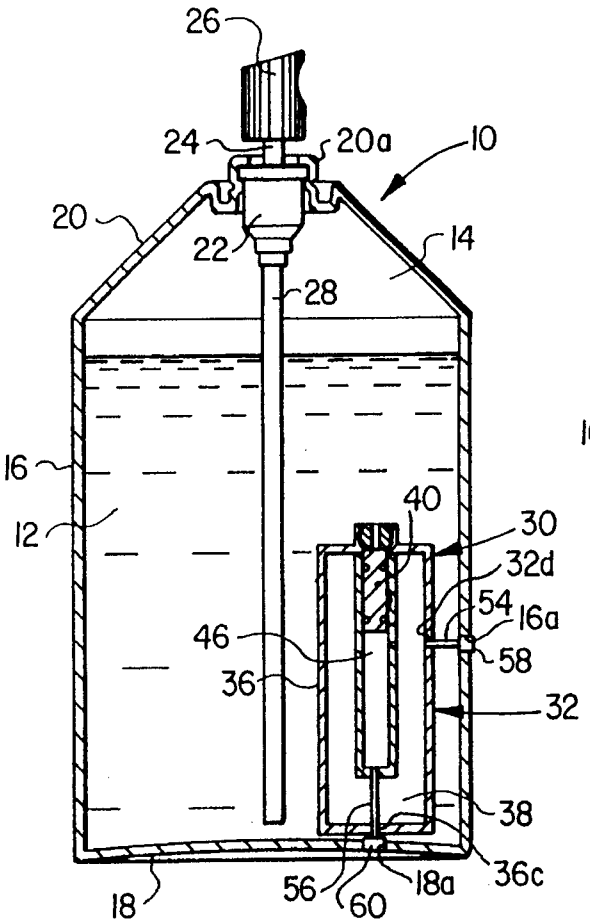
FIG. 4 is a view similar to FIG. 1 showing a method of charging the pressure generator within a dispensing apparatus.

Another preferred embodiment of the present invention is shown in FIG. 4 which includes all of the components of the embodiment of FIGS. 1 and 2A–B which are given the same reference numerals. The spring 48 has not been shown in FIG. 4 for the convenience of presentation. According to the embodiment of FIG. 4, a tube 54 registers with and extends between an opening 32*d* formed through the wall of the vessel 32 and an opening 16*a* formed through the wall 16 of the container 10. In addition, a tube 56, which passes through the bottom of the vessel 32, registers with and extends between an opening 36*c* formed through the wall of the cylinder 36 and an opening 18*a* formed through the bottom plate 18 of the container 10. Preferably, the tubes 54 and 56 are sealed with rubber valves 58 and 60, respectively, to prevent the escape of gas from the chambers 38 and 46 while providing a means for recharging and adjusting the pressure in the chambers after the pressure generator 30 is enclosed in the container 10. Although not shown in the drawings, it is understood that the valves 58 and 60 could include pressure sensors and automated controls to continuously maintain the pressure within the chambers 38 and 46 at their proper levels. Otherwise, the embodiment of FIG. 4 operates in the same manner as the embodiments of FIGS. 1 and 2A–B.

According to the embodiments of FIGS. 5A–D, pressure generators are provided, each of which is an integral part of the container 10. The spring 48 has again not been shown for the convenience of presentation. Referring specifically to the embodiment of FIG. 5A, a pressure generator 62 is shown disposed in the bottom portion of the container 10. A high pressure chamber 64 is defined by the lower portion of the cylindrical wall 16, the bottom plate 18, and a horizontal partition 66 which extends across, and is integral with, the container 10. An opening 68 is provided in the bottom plate 18 and is sealed by a rubber valve 70 to provide a means for recharging and adjusting the pressure in the high pressure chamber 64 after the container 10 is sealed. In all other respects, the pressure generator 62 is identical to the pressure generator 30, with the high pressure chamber 64 of the embodiment of FIG. 5A being functionally equivalent to the high pressure chamber 38 of the embodiment of FIGS. 1 and 2A–B.

Figure 5A:
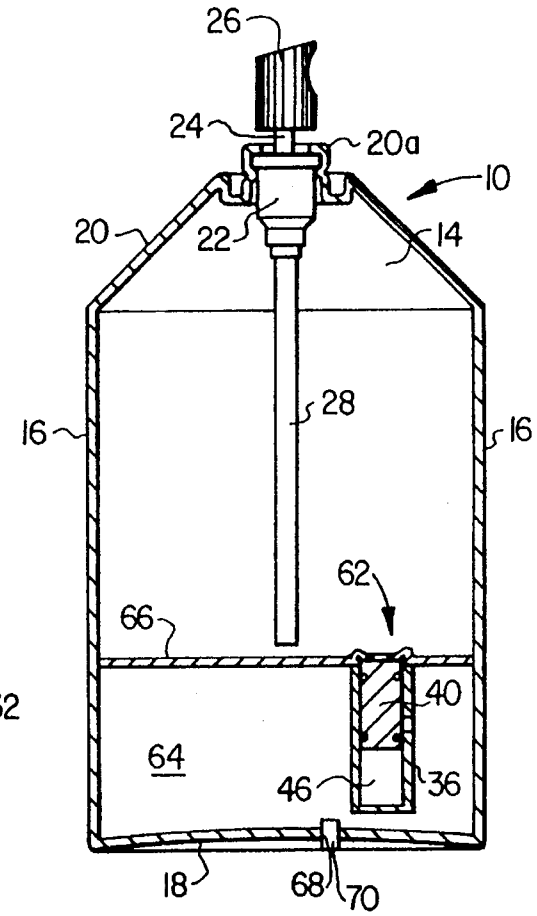
FIGS. 5A—5D and 6 are views similar to FIG. 1 showing other preferred embodiments of the dispensing apparatus of the present invention.
Figure 5D:
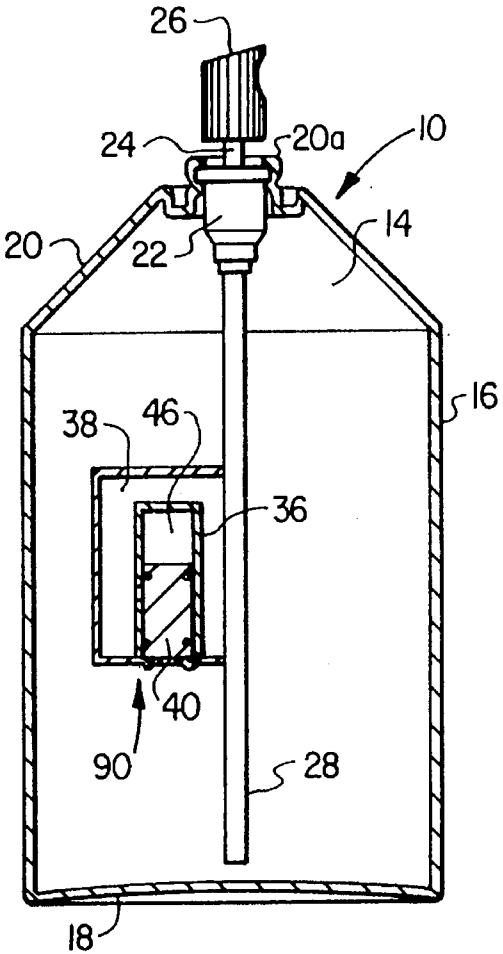
Figure 5C:
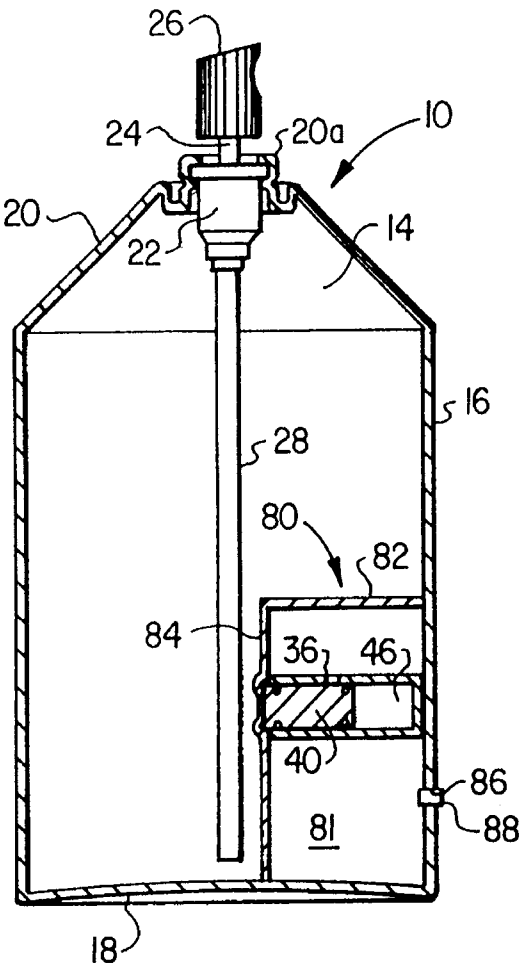
Figure 5B:
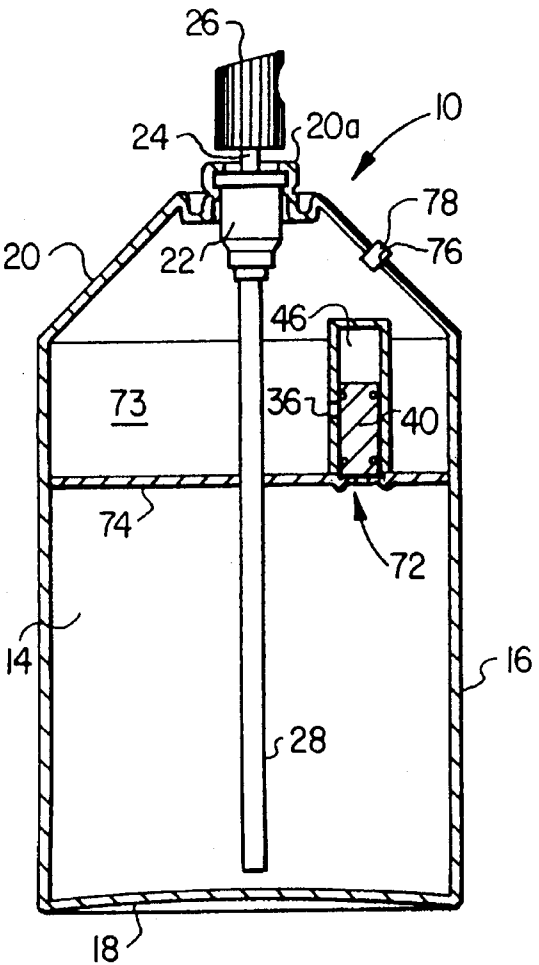

Referring now to the embodiment of FIG. 5B, a pressure generator 72 is shown disposed in the upper portion of the container 10. A high pressure chamber 73 is defined by the upper portion of the cylindrical wall 16, the cap 20, and a horizontal partition 74 which extends across, and is integral with, the container 10. An opening 76 is provided in the cap 20 and is sealed by a rubber valve 78 to provide a means for recharging and adjusting the pressure in the high pressure chamber 73 after the container 10 is sealed. In all other respects, the pressure generator 72 is identical to the pressure generator 30, with the high pressure chamber 73 of the embodiment of FIG. 5B being functionally equivalent to the high pressure chamber 38 of the embodiment of FIGS. 1 and 2A–B.

Referring to the embodiment of FIG. 5C, a pressure generator 80 is again shown disposed in the lower portion of the container 10, but the pressure generator 80 is rotated ninety degrees from the position shown in FIG. 5A. A high pressure chamber 81 is defined by a portion of the lower portion of the cylindrical wall 16, a portion of the bottom plate 18, a top plate 82, and a curved wall 84. An opening 86 is provided in the wall 16 and is sealed by a rubber valve 88 to provide a means for recharging and adjusting the pressure in the high pressure chamber 81 after the container 10 is sealed. In all other respects, the pressure generator 80 is identical to the pressure generator 30, with the high pressure chamber 81 of the embodiment of FIG. 5C being functionally equivalent to the high pressure chamber 38 of the embodiment of FIGS. 1 and 2A–B.

Referring to the embodiment of FIG. 5D, a pressure generator 90, identical to the pressure generator 30, is shown attached to the tube 28. Otherwise, the pressure generator 90 operates in the same manner as the embodiment of FIGS. 1 and 2A–B.

It is thus seen and further understood that the pressure generator of the present invention can have various dimensions and be disposed in numerous locations within the container 10, with portions of the pressure generator being defined by portions of the container 10 to provide numerous manufacturing options.

Figure 6:
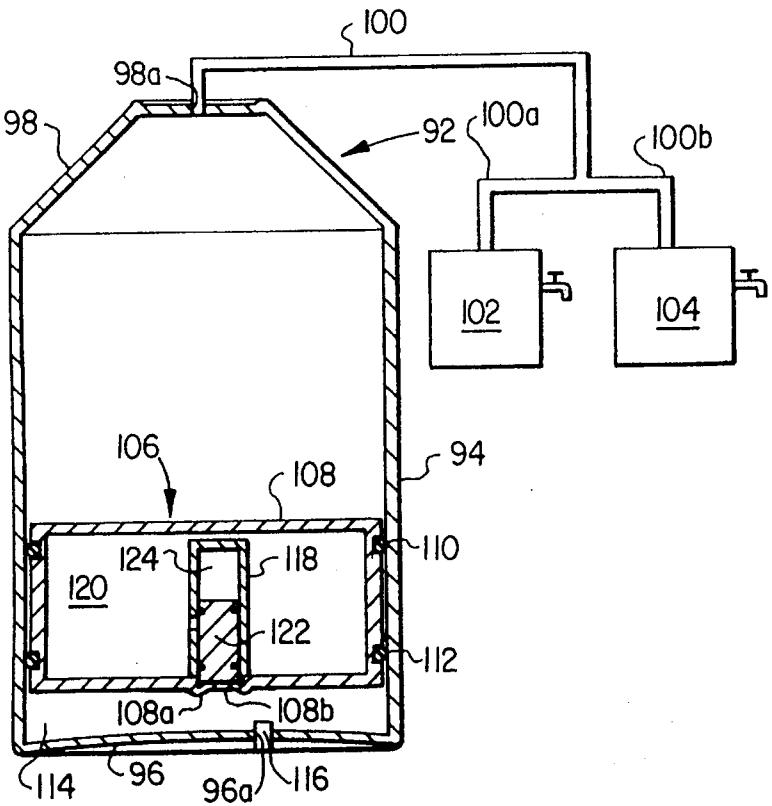

Referring to FIG. 6, another preferred embodiment of the present invention is shown in which the reference numeral 92 refers in general to a container for containing and dispensing a product. The container 92 is formed by a cylindrical wall 94 closed at its lower end by a bottom plate 96 and at its upper end by a cap 98. It is understood that the container 92 can be an aerosol can, a vat, a beer or beverage keg, a storage vessel, a bottle or any other type of container used for the storage and dispersement of a product and can have any desired shape or configuration.

A pipe 100 registers with and extends from an opening 98*a* in the cap 98. The pipe 100 branches into two branches 100*a* and 100*b* for passing product from the container 92 to two dispensing containers 102 and 104, respectively.

A pressure generator for pressurizing the container 92 is referred to in general by the reference numeral 106. The pressure generator 106 is formed by a cylindrical vessel 108 having a closed upper end and a lower end having a neck 100*a* which defines an opening 100*b*. The neck 100*a* is adapted to receive a cannulated plug (not shown) similar to the plug 34 previously described. In a preferred embodiment, the neck 100*a* is pliable and can be folded down to partially block the opening 100*b*, as is shown in FIG. 6.

The outer diameter of the vessel 108 is slightly less than the inner diameter of the container 92 to permit reciprocal movement of the vessel 108 in the container 92. Two axially spaced annular grooves are provided near the respective ends of the vessel 108 and receive two sealing members, preferably in the form of O-rings, 110 and 112.

A chamber 114 is defined between the lower end of the vessel 108 and the bottom plate 96 of the container 94. To urge the vessel 108 upwardly for reasons described below, the chamber 114 is pressurized through an opening 96*a* in the bottom plate 96 which is sealed with a rubber valve 116.

A cylinder 118 is disposed in the vessel 108 and has a closed upper end and an open lower end. The lower end is integrally connected to the lower end of the vessel 108 in alignment with the opening 100*b* by welding or the like. The diameter and the length of the cylinder 118 are less than the diameter and length, respectively, of the vessel 108 to define a high pressure chamber 120.

A piston 122 operates within the cylinder 118 and defines a prepressure chamber 124. The cylinder 118 and the piston 122 are identical to the cylinder 36 and the piston 40 of the embodiment of FIGS. 2A and 2B, and thus will not be described in further detail. Again, the spring 48 has not been shown for the convenience of presentation.

Before operation, the chambers 120 and 124 of the vessel 108 are charged to respective predetermined pressures with a quantity of inert gas such as air, nitrogen, nitrous oxide, carbon dioxide or the like. In a preferred embodiment, the chamber 124 is charged to a pressure that is equal to the pressure needed in the containers 102 and 104 to propel product from the containers 102 and 104 at a predetermined flow rate. The chamber 120 is pressurized to a greater pressure than the chamber 124 to recharge the pressure in the chamber 114 as will be described. Since the methods of charging the chambers 120 and 124 are identical to the methods of charging the chambers 38 and 46 of the embodiment of FIGS. 2A and 2B, they will not be discussed here in detail.

After the chambers 120 and 124 are charged, the pressure generator 106 is placed in the container 92 in the orientation shown in FIG. 6. The container 92 is then filled with product, and the chamber 114 charged via the valve 116 to a predetermined pressure with a gas similar to the gas used to charge the chambers 120 and 124. The pressure in the chamber 114 is selected to be initially greater than force exerted on the piston 122 by the gas in the chamber 124 and any spring present therein. The pressure in the chamber 114 thus acts through the opening 100*b* of the vessel 108 on the lower end of the piston 122 to force it upwardly to its operating position as previously described in connection with the embodiment of FIGS. 2A and 2B.

When product is dispensed from either of the containers 102 or 104, the pressure in the containers 102 and 104, and therefore in the container 92, is decreased. This causes the vessel 108 to rise upwardly in the container 92 to equalize the pressures in the chamber 114 and in the containers 92, 102 and 104. The upward movement of the vessel 108 decreases the pressure in the chamber 114 and thus the force exerted on the lower end of the piston 122. Upon this occurring, the piston 122 is forced downwardly by the pressure in the chamber 124, thereby releasing pressurized gas from the chamber 120 as described in connection with the embodiment of FIGS. 2A and 2B.

The pressure in the chamber 114 is thus increased, which accordingly urges the vessel 108 to rise further within the container 92 which accordingly increases the pressure in the containers 92, 102 and 104. The release of the pressurized gas from the chamber 120 continues until the pressure in the containers 92, 102 and 104 and in the chamber 114 is equal to the pressure in the chamber 124. At this time, the piston 122 will move back to its blocking position.

This back-and-forth movement of the piston 122 relative to the cylinder 118 and the upward movement of the vessel 108 within the container 92 continues in the manner described above as product is periodically dispensed from the containers 102 and 104. As a result, a constant pressure will be available in the containers 102 and 104 at all times to propel product from the containers at a constant flow rate, while the propellant utilized can be an inert gas which is not harmful to the environment. Further, the propellant gas is separated from the product to prevent any contamination.

Figure 7B:
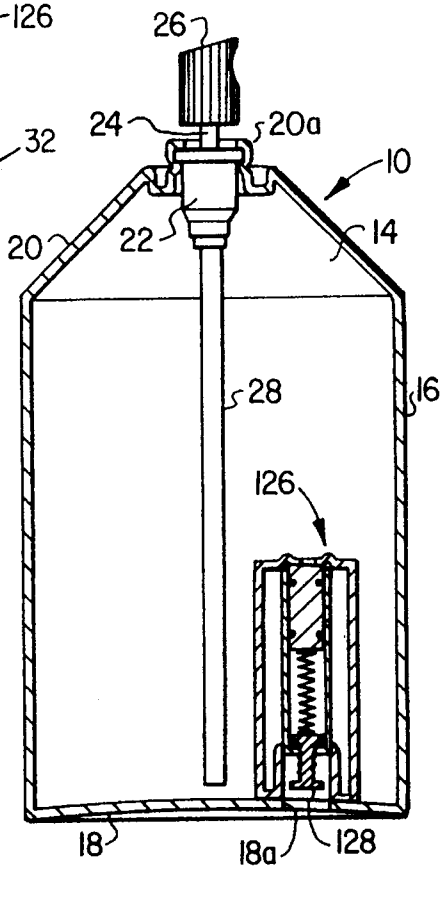
FIG. 7B is a view similar to FIG. 1 showing the pressure generator of FIG. 7A within a dispensing apparatus.
Figure 7A:
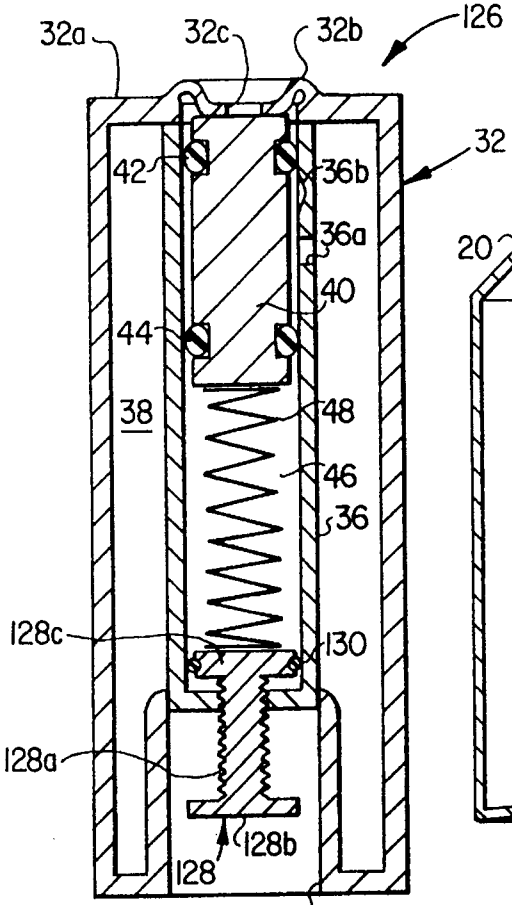
FIG. 7A is an enlarged sectional view of another preferred embodiment of the pressure generator shown in FIG. 2A.

An additional preferred embodiment of the pressure generator of the present invention is shown in FIGS. 7A and 7B and is referred to in general by the numeral 126. The pressure generator 126 is similar to the pressure generator 30 shown in FIG. 2A but includes an adjustment control 128 for mechanically adjusting the pressure in the chamber 46 by adjusting the volume of the chamber 46 (and by adjusting the length of the spring 48 if present). The control 128 includes a shaft 128*a* threadingly coupled through the upper end of a neck 36' formed in the lower end portion of the cylinder 36 and a knob 128*b* formed on the shaft 128*a* and disposed in the neck 36' for engagement either manually or via control means (not shown). A platform 128*c* is formed on the other end of the shaft 128*a* disposed inside of the cylinder 36 to vary the volume of the chamber 46 as the shaft moves axially relative to the cylinder 36. The platform 128*c* includes an annular groove which receives a sealing member, preferably in the form of an O-ring, 130. It is understood that the pressure generator 126 can replace any of the pressure generators previously described, in which case, the pressure in the chamber 46 would only be adjustable by the control 128 prior to enclosure within the container 10.

According to the embodiment of FIG. 7B, a pressure generator 126' is provided which is identical to the pressure generator 126 of the previous embodiment but is formed integral with the container 10. More particularly, an opening 18*a* is provided in the bottom plate 18 over which the neck 36' extends to provide access to the control 128 even after the container 10 has been sealed.

Figure 8:
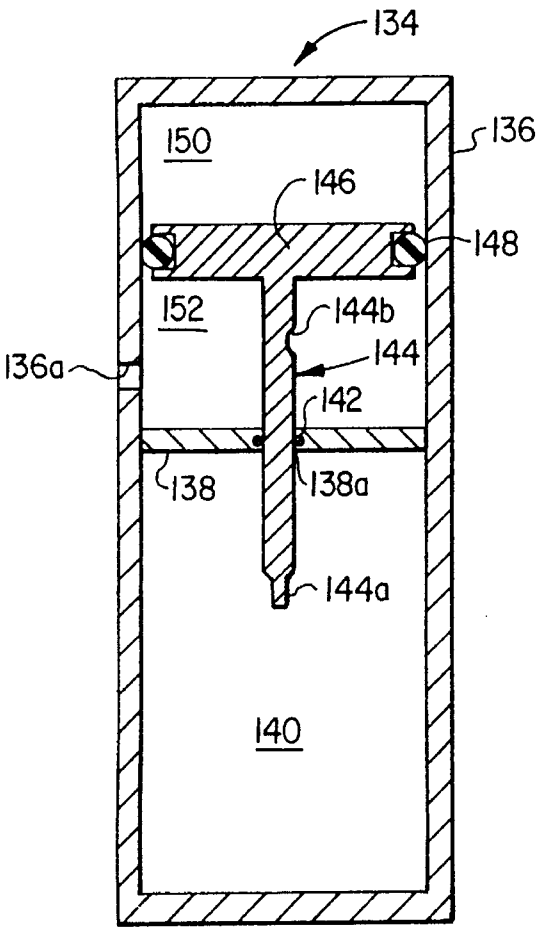
FIG. 8 is an enlarged sectional view of another preferred embodiment of the pressure generator shown in FIG. 2A.

An additional preferred embodiment of a pressure generator which is also adapted to operate within the container 10 is shown in FIG. 8 and is referred to in general with the numeral 134. The pressure generator 134 is formed by a cylindrical vessel 136 having closed lower and upper ends. An opening 136*a* is provided through the wall of the vessel 136 for reasons to be described.

A horizontal partition 138 is integrally secured within the vessel 136 and defines a high pressure chamber 140 disposed between the partition 138 and the lower end of the vessel 136. An opening 138*a* is provided through the partition 138 disposed coaxially with the vessel 136. An annular groove is formed in that portion of the partition 138 defining the opening 138*a* for receiving a sealing member, preferably in the form of an O-ring, 142.

A piston rod 144 attached to a plunger 146 operates within the vessel 136 and extends through the opening 138*a* with the plunger 146 disposed above the partition 138. The rod 144 has a tapered lower end 144*a* and a notch, or groove, 144*b* is formed in the rod 144 above the partition 138 for reasons to be described. An annular groove is provided in the outer circumference of the plunger 146 and receives a sealing member, preferably in the form of an O-ring, 148. A prepressure chamber 150 is defined between the plunger 146 and the upper end of the vessel 136 which is pressurized to urge the plunger 146 downwardly, as will be described. A chamber 152 is defined between the plunger 146 and the partition 138, is pressurized to urge the plunger 146 upwardly.

Before operation, the chambers 140 and 150 of the pressure generator 134 are charged to respective predetermined pressures with a quantity of inert gas such as air, nitrogen, nitrous oxide, carbon dioxide or the like. In a preferred embodiment, the chamber 150 is charged to a pressure that, when the plunger 146 is in the position shown in FIG. 8, is approximately equal to the pressure needed to propel the product 12 from the container 10. The chamber 140 is pressurized to a greater pressure than the chamber 150 to recharge the pressure in the container 10 as is described below.

To this end, the plunger 146 is lowered below the opening 136*a* in the vessel 136. Then, pressurized gas is introduced from the opening 136*a* to the chamber 150. The plunger 146 is then raised such that the O-ring 148 is above the opening 136*a* to seal the gas in the chamber 150.

To charge the chamber 140, pressurized gas is introduced to the chamber 152 via the opening 136*a* to urge the plunger 146 upwardly. The pressure within the chamber 152 is increased until the plunger 146 is raised to a height such that the tapered end 144*a* of the rod 144 is disposed within the opening 138*a* to allow the gas to pass through the opening 138*a* and into the chamber 140. The introduction of gas is continued until the chamber 140 is pressurized to the predetermined level. When the introduction of the gas through the opening 136*a* of the vessel 136 is terminated, the plunger 146 is urged downwardly by the pressure in the chamber 150 to the position shown in FIG. 8. In this position, the O-ring 142 seals against the egress of the pressurized gas contained in the chamber 140.

After the chambers 140 and 150 are charged, the pressure generator 134 is placed in the container 10 which contains the product 12 to be dispensed, and the headspace 14 in the container 10 is charged to a predetermined pressure with a gas similar to the gas used to charge the chambers 140 and 150 of the vessel 136. This predetermined pressure is also established in the chamber 152 by the opening 136*a*.

The plunger 146 remains in the position shown in FIG. 8 until the container 10 is used by manually pressing the push button 24, in which case the pressure in the headspace 14 of the container 10 propels the product 12 out of the container 10 via the openings in the push button 26 as previously described. This causes the pressure in the container 10, and accordingly the pressure in the chamber 152, to decrease until the pressure exerted on the plunger 146 by the pressurized gas in the chamber 150 is greater than the corresponding pressure acting on the bottom of the plunger 146 by the pressure in the chamber 152. Upon this occurring, the plunger 146 moves downwardly until the notch 144*b* of the rod 144 extends into the opening 138*a* in the partition 138. This permits the high pressure gas in the chamber 140 to pass through the opening 138*a*, through the chamber 152 and outwardly through the opening 136*a* into the container 10.

The pressure in the container 10, and accordingly the pressure in the chamber 152, is thus increased until the pressure exerted thereby on the bottom of the plunger 146 is sufficient to overcome the pressure exerted on the top of the plunger 146 by the pressure in the chamber 150. When this occurs, the plunger 146 moves back to the position shown in FIG. 8 thus blocking any further flow of high pressure gas from the chamber 140 into the container 10. According to a feature of this embodiment, should the pressure in the container 10 quickly drop a significant amount, due to a leak or the like, the pressure in the chamber 150 will force the piston 146 against the partition 138, thereby passing the notch 144*b* completely past the opening 138*a* and sealing the high pressure gas in the chamber 140.

This back-and-forth movement of the plunger 146 and the rod 144 relative to the partition 138 continues in the manner described above as the product 12 is periodically dispensed from the container 10. As a result, a constant pressure will be available in the container 10 at all times to propel the product 12 from the container 10, while the propellant utilized can be an inert gas which is not harmful to the environment.

Figure 9:
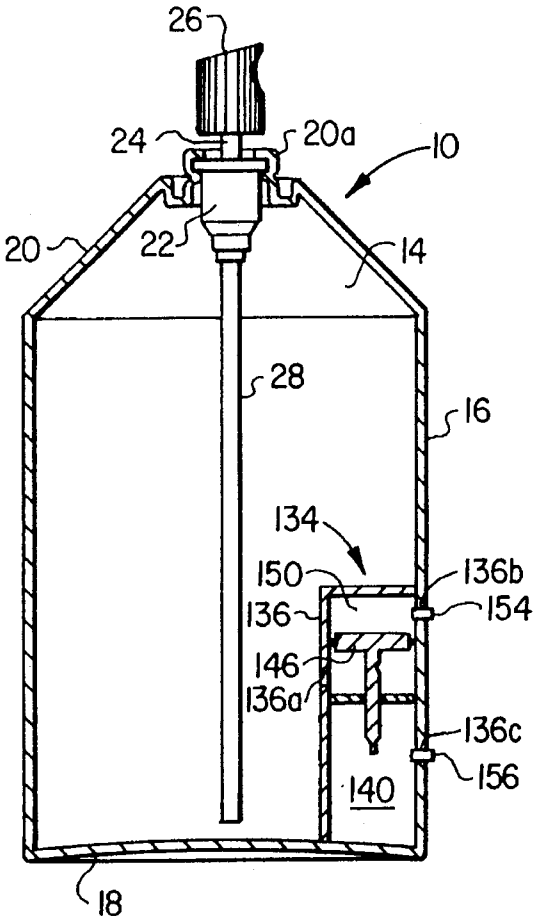
FIG. 9 is a view similar to FIG. 1 showing the pressure generator of FIG. 8 within a dispensing apparatus.

According to the embodiment of FIG. 9, the vessel 136 of the pressure generator 134 of the previous embodiment can be formed integrally with the container 10 to facilitate the previously described charging of the chambers 140 and 150. To this end, openings 136*b* and 136*c*, sealed with rubber valves 154 and 156, can be provided in the vessel 136 to provide a means for recharging and adjusting the pressure in the chambers 140 and 150, respectively, after the pressure generator 134 is sealed in the container 10. In all other respects, the pressure generator 134 of FIG. 9 is identical to the pressure generator 134 of FIG. 8.

Figure 10:
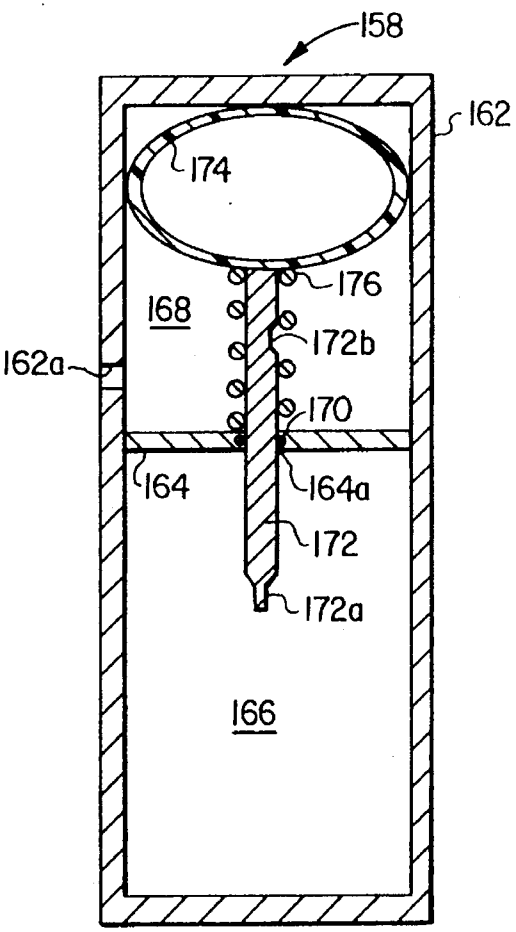
FIG. 10 is an enlarged sectional view of another preferred embodiment of the pressure generator shown in FIG. 8.

An additional preferred embodiment of the pressure generator of the present invention is shown in FIG. 10 and is referred to in general with the numeral 158. The pressure generator 158 is similar to the pressure generator 134 shown in FIG. 8 and is thus formed by a cylindrical vessel 162 having closed lower and upper ends and an opening 162*a* provided through the wall of the vessel 162.

A horizontal partition 164 is integrally secured within the vessel 162 and defines a high pressure chamber 166 disposed between the partition 164 and the lower end of the vessel 162, and an upper chamber 168 disposed between the partition 164 and the upper portion of the vessel 162. An opening 164*a* is provided through the partition 164 disposed coaxially with the vessel 162. An annular groove is formed in that portion of the partition 164 defining the opening 164*a* for receiving a sealing member, preferably in the form of an O-ring, 170.

A piston rod 172 extends through the opening 164*a* and has a balloon 174 affixed to its upper end and thus extending in the chamber 168. The rod 172 has a tapered lower end 172*a* and a notch, or groove, 172*b* formed in the rod 172 above the partition 164 for reasons to be described. A spring 176 is disposed around the rod 172 and extends between the partition 164 and the balloon 174. The chamber 168 is pressurized and thus, along with the spring 176, urges the balloon 174 upwardly, against the downwardly directed force of the balloon 174.

Before operation, the balloon 174 and the chamber 166 are charged to respective predetermined pressures with a quantity of inert gas such as air, nitrogen, nitrous oxide, carbon dioxide or the like. In a preferred embodiment, the balloon 174 is charged to a pressure that, when the balloon 174 is in the position shown in FIG. 10, is approximately equal to the pressure needed to propel the product 12 from the container 10. The chamber 166 is pressurized to a greater pressure than the balloon 174 to recharge the pressure in the container 10 as is described below.

To charge the chamber 166, pressurized gas is introduced to the chamber 168 via the opening 162*a* to exert pressure on the balloon 174 and cause it to contract. As the balloon 174 reduces in size, it along with the spring 176 urges the rod 172 upwardly within the vessel 162. The pressure within the chamber 168 is increased until the rod 172 is raised to a height such that the tapered end 172*a* of the rod 172 is disposed within the opening 164*a* to allow the gas to pass through the opening 164*a* and into the chamber 166. The introduction of gas is continued until the chamber 166 is pressurized to the predetermined level. When the introduction of the gas through the opening 162*a* of the vessel 162 is terminated, the pressure on the balloon 174 decreases causing the balloon 174 to expand. As a result of this expansion, the rod 172 is urged downwardly to the position shown in FIG. 10. In this position, the O-ring 170 seals against the flow of the pressurized gas contained in the chamber 166.

After the chamber 166 is charged, the pressure generator 158 is placed in the container 10 which contains the product 12 to be dispensed, and the headspace 14 in the container 10 is charged to a predetermined pressure with a gas similar to the gas used to charge the chamber 166.

The rod 172 remains in the position shown in FIG. 10 until the container 10 is used by manually pressing the push button 26, in which case the pressure in the headspace 14 of the container 10 propels the product 12 out of the container 10 via the openings in the push button 26 as previously described. This causes the pressure in the container 10, and accordingly the pressure in the chamber 168, to decrease causing the balloon 174 to expand. As the balloon expands, the rod 172 is pushed downwardly until the notch 172*b* of the rod 172 extends into the opening 164*a* in the partition 164. This permits the high pressure gas in the chamber 166 to pass through the opening 164*a*, through the chamber 168 and outwardly through the opening 162*a* into the container 10.

The pressure in the container 10, and accordingly the pressure in the chamber 168, is thus increased until the pressure exerted thereby on the balloon 174 is sufficient to reduce the balloon 174 to a size which moves the rod 172 back to the position shown in FIG. 10, thus blocking any further flow of high pressure gas from the chamber 166 into the container 10 as described above.

This back-and-forth movement of the rod 172 relative to the partition 164 continues in the manner described above as the product 12 is periodically dispensed from the container 10. As a result, a constant pressure will be available in the container 10 at all times to propel the product 12 from the container 10, while the propellant utilized can be an inert gas which is not harmful to the environment.

It is thus seen that the dispensing apparatus of the present invention provides several advantages, not the least significant of which is that it provides a dispenser capable of dispensing a product at a constant pressure throughout the life of the product without having to use an environmentally hazardous propellant, the intended propellants being air, nitrogen, nitrous oxide, carbon dioxide and the like. In fact, in the embodiment shown in FIG. 6, a dispensing apparatus is disclosed which does not discharge any propellant into the atmosphere. The present invention also enables a precise, constant pressure to be simultaneously maintained in numerous discharge vessels by the utilization of a single pressure generator in a common storage container, as is described in connection with FIG. 6 but which is equally applicable to the other embodiments.

The present invention also incorporates an emergency shut-off system which prevents further discharge of the high pressure gas when a major pressure reduction is experienced. This safety feature ensures that no high pressure gas escapes when the container is malfunctioning.

Another advantage of the present invention is its ability to accommodate the needs of various container manufactures. The pressure generator can be proportioned for any size container and can be located at any orientation within each container. Further, the pressure generator can either be loose within a container or be integrally incorporated into the structure and walls of the container.

The present invention also offers container manufacturers the ability to either buy the pressure generators precharged or uncharged. While many pressure generators cannot be easily transported, the pressure generator of the present invention can be since the actuating pistons are normally positioned to prevent any undesired discharge of pressurized gas until inserted into a pressurized container. Therefore, the pressure generator can be supplied to the container manufacturer precharged to the desired pressures, and is simply inserted into the container along with the product. Due to the ease at which the pressure generator of the present invention may be charged, however, container manufactures may purchase the pressure generators uncharged. In this way, they need not buy numerous pressure generators charged to each of the various pressure levels they desire.

In addition, the present invention offers many embodiments which may be provided with means to charge the pressure chambers after being sealed inside a container. This provides the ability to easily charge the pressure generator, as well as the ability to recharge the pressure chambers as needed. Further, the pressure levels in the pressure chambers may be continuously monitored and recharged to maintain precision, such as by a computer controlled system.

The pressure generator of the present invention is also easily assembled due to the few components required and the simplicity of those components. Further, the pressure generator requires no manual actuation before or doing use.

It is understood that several variations may be made in the foregoing without departing from the scope of the present invention. For example, the pressure generators 30, 62, 72, 80, 90, 106, 126, 134 and 158 have been shown and described as having a particular orientation, although each could be disposed at any other orientation. Further, the pressures in the prepressure chambers 46, 124 and 150 can be provided by high pressure gas alone, by a spring 48 alone, or by the combination of both.

In fact, external charging of the prepressure chambers 46, 124 and 150 or the use of a spring 48 can be avoided altogether by the approriate dimensioning of the cylinders 36 and 118, and the upper portion of the vessel 136, respectively. For example, as the pressure generator 30 is assembled, the air already present in the cylinder 36 is compressed by the insertion of the piston 40. Therefore, the cylinder 36 and the piston 40 can be appropriately dimensioned such that as the piston 40 moves to its operating position as shown in FIG. 2B, the air present in the chamber 46 is compressed to the desired prepressurized level for the chamber 46.

Numerous features have been disclosed, some of them independently of others. It is understood, however, that various features of the present invention may be combined. For example, a pressure charging tube similar to the tube 56 of FIG. 4 may be formed through the adjustment control 128 to provide added functionality to the embodiment of FIG. 7A. In addition, tubes similar to the tubes 54 and 56 shown in FIG. 4 may be provided in the embodiment of FIG. 9 to allow the pressure generator 134 to be inserted loose into the container 10 but still allow charging and adjustment of the pressure in the chambers 140 and 150 after closure of the container 10.

The components of the pressure generators of the present invention have been primarily described and shown in the drawings as being metal. These components, however, such as the vessel, the cylinder, the piston, the plug, the plunger and the rod, can be metal (preferably aluminum), plastic (preferably polyoxymethalene or polyethelene terephthalate), or any other like material. In addition, the O-rings 42, 44, 110, 112, 130, 142, 148 and 170 can be replaced with other types of movable seals such as quadring, rings, scrapers and the like, which can either be separate from the other components or jointly molded thereon. For example, a piston formed of plastic may have annular ridges formed thereon to provide the needed sealing and reciprocal movement within the cylinder.

Further, whereas the plug 34 was described as being press fit into the neck 32*b* of the vessel 32, it is understood that the plug 34 could be threadably connected to the neck 32*b*, as well as being glued or welded in place. In addition, the rubber valves 58, 60, 68, 78, 88 and 116 need not be rubber, or in fact, be permanent valves at all. The corresponding openings may simply be plugged by pins or the like which ensure proper sealing. The openings may of course be either permanently closed, as by welding, or contain removable plugs.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. Apparatus for maintaining a constant predetermined pressure in a pressurized container for dispensing product contained in the container from the container at said constant pressure, said apparatus comprising:

a vessel disposed in said container;

a cylinder member disposed in said vessel and defining with said vessel a first chamber for containing pressurized gas;

a piston member disposed in said cylinder member;

one of said members being exposed to the pressure in said container for moving relative to the other member;

means responsive to said movement for selectively permitting said pressurized gas to pass from said first chamber to said container;

neck means extending from an end of said cylinder member; and plug means disposed in said neck means to normally retain said piston member in said cylinder member to permit said movement, said plug means being removable from said neck means to permit said piston member to project from said cylinder member so that said first chamber can be charged with said pressurized gas member and said cylinder member define an additional chamber and said one member is exposed to the pressure in said container for moving to a first position relative to the other member when said pressure in said container equals said predetermined pressure; and further comprising means in said additional chamber for moving said one member to a second position relative to said other member in response to the pressure in said container decreasing below said predetermined pressure.

2. The apparatus of claim 1 wherein said piston member and said cylinder member define an additional chamber and said one member is exposed to the pressure in said container for moving to a first position relative to the other member when said pressure in said container equals said predetermined pressure; and further comprising means in said additional chamber for moving said one member to a second position relative to said other member in response to the pressure in said container decreasing below said predetermined pressure.

3. The apparatus of claim 2 wherein said permitting means is responsive to said one member moving to said second position for connecting said first chamber with said container to permit said pressurized gas to pass from said first chamber to said container, said permitting means being responsive to said one member moving to said first position for disconnecting said first chamber with said container to prevent said passage of said pressurized gas.

4. The apparatus of claim 3 wherein said cylinder member is secured relative to said vessel and said piston member is exposed to the pressure in said container and moves relative to said cylinder member to said first and second positions.

5. The apparatus of claim 4 wherein one end of said piston member is exposed to the pressure in said container and wherein said additional chamber is defined between said cylinder member and the other end of said piston member.

6. The apparatus of claim 5 wherein said moving means comprises pressurized gas disposed in said additional chamber and acting on said other end of said piston member.

7. The apparatus of claim 1 wherein the outer diameter of said piston member is slightly less than the inner diameter of said cylinder member to permit the flow of said pressurized gas therebetween from said first chamber to said container.

8. The apparatus of claim 7 wherein at least one sealing member extends between an outer surface of said piston member and a corresponding inner surface of said cylinder member for preventing said flow of pressurized gas when said piston member is in said first position, and a notch formed in one of said surfaces for receiving said sealing member for permitting said flow of pressurized gas when said piston member is in said second position.

9. The apparatus of claim 8 wherein said sealing member extends in a groove formed in said piston member and engages the inner surface of said cylinder member and wherein said notch is formed in the inner surface of said cylinder member.

10. Apparatus for maintaining a constant predetermined pressure in a pressurized container for dispensing product contained in the container from the container at said constant pressure, said apparatus comprising:

a vessel disposed in said container;

a cylinder member disposed in said vessel and defining with said vessel a first chamber for containing pressurized gas;

a piston member disposed in said cylinder member;

one of said members being exposed to the pressure in said container for moving relative to the other member;

means responsive to said movement for selectively permitting said pressurized gas to pass from said first chamber to said container; and neck means extending from an end of said cylinder member to permit said piston member to initially project from said cylinder member so that said first chamber can be charged with said pressurized gas, a portion of said neck means being adjustable to thereafter partially block said end of said cylinder member to retain said piston member in said cylinder member to permit said movement.

11. The apparatus of claim 10 wherein said piston member and said cylinder member define an additional chamber and said one member is exposed to the pressure in said container for moving to a first position relative to the other member when said pressure in said container equals said predetermined pressure; and further comprising means in said additional chamber for moving said one member to a second position relative to said other member in response to the pressure in said container decreasing below said predetermined pressure.

12. The apparatus of claim 11 wherein said permitting means is responsive to said one member moving to said second position for connecting said first chamber with said container to permit said pressurized gas to pass from said first chamber to said container, said permitting means being responsive to said one member moving to said first position for disconnecting said first chamber with said container to prevent said passage of said pressurized gas.

13. The apparatus of claim 12 wherein said cylinder member is secured relative to said vessel and said piston member is exposed to the pressure in said container and moves relative to said cylinder member to said first and second positions.

14. The apparatus of claim 13 wherein one end of said piston member is exposed to the pressure in said container and wherein said additional chamber is defined between said cylinder member and the other end of said piston member.

15. The apparatus of claim 14 wherein said moving means comprises pressurized gas disposed in said additional chamber and acting on said other end of said piston member.

16. The apparatus of claim 10 wherein the outer diameter of said piston member is slightly less than the inner diameter of said cylinder member to permit the flow of said pressurized gas therebetween from said first chamber to said container.

17. The apparatus of claim 16 wherein at least one sealing member extends between an outer surface of said piston member and a corresponding inner surface of said cylinder member for preventing said flow of pressurized gas when said piston member is in said first position, and a notch formed in one of said surfaces for receiving said sealing member for permitting said flow of pressurized gas when said piston member is in said second position.

18. The apparatus of claim 17 wherein said sealing member extends in a groove formed in said piston member and engages the inner surface of said cylinder member and wherein said notch is formed in the inner surface of said cylinder member.

19. Apparatus for maintaining a constant predetermined pressure in a pressurized container for dispensing product contained in the container from the container at said constant pressure, said apparatus comprising:

a vessel disposed in said container;

a cylinder member disposed in said vessel and defining with said vessel a first chamber for containing pressurized gas;

a piston member disposed in said cylinder member;

one of said members being exposed to the pressure in said container for moving relative to the other member;

means responsive to said movement for selectively permitting said pressurized gas to pass from said first chamber to said container;

two aligned openings respectively extending through said vessel and said container; and tube means connecting said aligned openings to permit pressurized gas to be introduced through said container into said first chamber.

20. The apparatus of claim 19 wherein said piston member and said cylinder member define an additional chamber and said one member is exposed to the pressure in said container for moving to a first position relative to the other member when said pressure in said container equals said predetermined pressure; and further comprising means in said additional chamber for moving said one member to a second position relative to said other member in response to the pressure in said container decreasing below said predetermined pressure.

21. The apparatus of claim 20 further comprising:

three additional aligned openings respectively extending through said cylinder member, said vessel and said container; and additional tube means connecting said additional aligned openings to permit pressurized gas to be introduced through said container into said additional chamber.

22. The apparatus of claim 28 wherein said permitting means is responsive to said one member moving to said second position for connecting said first chamber with said container to permit said pressurized gas to pass from said first chamber to said container, said permitting means being responsive to said one member moving to said first position for disconnecting said first chamber with said container to prevent said passage of said pressurized gas.

23. The apparatus of claim 22 wherein said cylinder member is secured relative to said vessel and said piston member is exposed to the pressure in said container and moves relative to said cylinder member to said first and second positions.

24. The apparatus of claim 23 wherein one end of said piston member is exposed to the pressure in said container and wherein said additional chamber is defined between said cylinder member and the other end of said piston member.

25. The apparatus of claim 24 wherein said moving means comprises pressurized gas disposed in said additional chamber and acting on said other end of said piston member.

26. The apparatus of claim 19 wherein the outer diameter of said piston member is slightly less than the inner diameter of said cylinder member to permit the flow of said pressurized gas therebetween from said first chamber to said container.

27. The apparatus of claim 26 wherein at least one sealing member extends between an outer surface of said piston member and a corresponding inner surface of said cylinder member for preventing said flow of pressurized gas when said piston member is in said first position, and a notch formed in one of said surfaces for receiving said sealing member for permitting said flow of pressurized gas when said piston member is in said second position.

28. The apparatus of claim 27 wherein said sealing member extends in a groove formed in said piston member and engages the inner surface of said cylinder member and wherein said notch is formed in the inner surface of said cylinder member.

29. Apparatus for maintaining a constant predetermined pressure in a pressurized container for dispensing product contained in the container from the container at said constant pressure, said apparatus comprising:

a vessel disposed in said container;

a cylinder member disposed in said vessel and defining with said vessel a chamber for containing pressurized gas;

a piston member disposed in said cylinder member;

one of said members being exposed to the pressure in said container so that said pressure applies a first force to said one member, means for applying a second force to said one member in an opposite direction to said first force so that said one member moves relative to the other member when said forces are not equal;

means responsive to said movement for selectively permitting said pressurized gas to pass from said chamber to said container; and means for adjusting said second force to vary said movement.

* * * * *